US007398030B2

(12) United States Patent
Nakamura et al.

(10) Patent No.: US 7,398,030 B2
(45) Date of Patent: Jul. 8, 2008

(54) IMAGE FORMING APPARATUS AND OUTPUT CONTROL METHOD OF THE SAME

(75) Inventors: Akihiro Nakamura, Mishima (JP); Kaoru Sato, Minamiashigara (JP); Ryuichi Yoshizawa, Numazu (JP); Kazuhisa Maruyama, Sagamihara (JP); Atsuya Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 472 days.

(21) Appl. No.: 11/257,654

(22) Filed: Oct. 25, 2005

(65) Prior Publication Data

US 2006/0115290 A1 Jun. 1, 2006

(30) Foreign Application Priority Data

Oct. 29, 2004 (JP) ..... 2004-317064
Sep. 28, 2005 (JP) ..... 2005-281954

(51) Int. Cl.
*G03G 15/00* (2006.01)

(52) U.S. Cl. ..... 399/82; 399/410

(58) Field of Classification Search ..... 399/18, 399/19, 21, 75, 76, 82, 405, 407, 408, 409, 399/410; 271/288, 298
See application file for complete search history.

(56) References Cited

U.S. PATENT DOCUMENTS

| | | | | |
|---|---|---|---|---|
| RE34,460 | E * | 11/1993 | Ishiguro et al. | 270/58.15 |
| 5,812,901 | A * | 9/1998 | Morikawa | 399/19 |
| 6,122,464 | A * | 9/2000 | Kakigi | 399/82 |
| 6,266,151 | B1 * | 7/2001 | Tachibana et al. | 358/1.4 |
| 6,347,203 | B1 * | 2/2002 | Kutsuwada | 399/82 |
| 6,373,581 | B1 | 4/2002 | Kimizuka | |
| 6,519,429 | B2 * | 2/2003 | Muramatsu | 399/82 |
| 2004/0247336 | A1 | 12/2004 | Yoshizawa | |

FOREIGN PATENT DOCUMENTS

| | | |
|---|---|---|
| JP | 9-39341 | 2/1997 |
| JP | 2004-271627 | 9/2004 |

* cited by examiner

*Primary Examiner*—Robert Beatty
(74) *Attorney, Agent, or Firm*—Canon USA Inc IP Div

(57) ABSTRACT

An image forming apparatus includes an output processing device determining an output process time in accordance with reservation information of a sheet of paper to be outputted, and a controller adjusting a paper transport interval in accordance with the output process time determined by the output processing device. Upon canceling the reservation information, the controller adjusts the paper transport interval of reservation information to be processed right after the canceled reservation information on the basis of an output process time of reservation information to be processed right before the canceled reservation information.

14 Claims, 12 Drawing Sheets

FIG. 3A

| PRINT JOB | PAPER NO. | OUTPUT BIN | OUTPUT MODE | DETERMINED OUTPUT PROCESS TIME (S) |
|---|---|---|---|---|
| A | 1 | 3 | 2-POINT STAPLES | 0.1 |
| A | 2 | 3 | 2-POINT STAPLES | 0.1 |
| A | 3 | 3 | 2-POINT STAPLES | 0.1 |
| B | 1 | 3 | 1-POINT STAPLE | 5 |
| B | 2 | 3 | 1-POINT STAPLE | 0.1 |
| B | 3 | 3 | 1-POINT STAPLE | 0.1 |
| B | 4 | 3 | 1-POINT STAPLE | 0.1 |
| C | 1 | 3 | STACK | 4 |
| C | 2 | 3 | STACK | 0.1 |
| C | 3 | 3 | STACK | 0.1 |

FIG. 3B

| LIST OF NECESSARY TIME (S) | |
|---|---|
| TIME FOR 1-POINT STAPLE | 4 |
| TIME FOR 2-POINT STAPLES | 5 |
| TIME FOR RECEIVING STACK | 0.1 |

FIG. 4

| PRINT JOB | PAPER NO. | OUTPUT BIN | OUTPUT MODE | PREVIOUSLY DETERMINED OUTPUT PROCESS TIME (S) | STORED OUTPUT PROCESS TIME (S) |
|---|---|---|---|---|---|
| A | 1 | 3 | 2-POINT STAPLES | 0.1 | 0.1 |
| A | 2 | 3 | 2-POINT STAPLES | 0.1 | 0.1 |
| A | 3 | 3 | 2-POINT STAPLES | 0.1 | 0.1 |
| B | 1 | 3 | 1-POINT STAPLE | 5 | 5 |
| B | 2 | 3 | 1-POINT STAPLE | 0.1 | 0.1 |
| B | 3 | 3 | 1-POINT STAPLE | 0.1 | 0.1 |
| ~~B~~ | ~~4~~ | ~~3~~ | ~~1-POINT STAPLE~~ | ~~0.1~~ | ~~0.1~~ |
| C | 1 | 3 | STACK | 4 | 4=MAX(0.1,4) |
| C | 2 | 3 | STACK | 0.1 | 0.1 |
| C | 3 | 3 | STACK | 0.1 | 0.1 |

FIG. 5

| PRINT JOB | PAPER NO. | OUTPUT BIN | OUTPUT MODE | PREVIOUSLY DETERMINED OUTPUT PROCESS TIME (S) | STORED OUTPUT PROCESS TIME (S) |
|---|---|---|---|---|---|
| A | 1 | 3 | 2-POINT STAPLES | 0.1 | 0.1 |
| A | 2 | 3 | 2-POINT STAPLES | 0.1 | 0.1 |
| A | 3 | 3 | 2-POINT STAPLES | 0.1 | 0.1 |
| B | 1 | 3 | 1-POINT STAPLE | 5 | 5 |
| ~~B~~ | ~~2~~ | ~~3~~ | ~~1-POINT STAPLE~~ | ~~0.1~~ | ~~0.1~~ |
| ~~B~~ | ~~3~~ | ~~3~~ | ~~1-POINT STAPLE~~ | ~~0.1~~ | ~~0.1~~ |
| ~~B~~ | 4 | ~~3~~ | ~~1-POINT STAPLE~~ | ~~0.1~~ | ~~0.1~~ |
| C | 1 | 3 | STACK | 4 | 4=MAX(0.1,4) |
| C | 2 | 3 | STACK | 0.1 | 0.1 |
| C | 3 | 3 | STACK | 0.1 | 0.1 |

FIG. 6

| PRINT JOB | PAPER NO. | OUTPUT BIN | OUTPUT MODE | PREVIOUSLY DETERMINED OUTPUT PROCESS TIME (S) | STORED OUTPUT PROCESS TIME (S) |
|---|---|---|---|---|---|
| A | 1 | 3 | 2-POINT STAPLES | 0.1 | 0.1 |
| A | 2 | 3 | 2-POINT STAPLES | 0.1 | 0.1 |
| A | 3 | 3 | 2-POINT STAPLES | 0.1 | 0.1 |
| ~~B~~ | ~~1~~ | ~~3~~ | ~~1-POINT STAPLE~~ | ~~5~~ | ~~5~~ |
| ~~B~~ | ~~2~~ | ~~3~~ | ~~1-POINT STAPLE~~ | ~~0.1~~ | ~~0.1~~ |
| ~~B~~ | ~~3~~ | ~~3~~ | ~~1-POINT STAPLE~~ | ~~0.1~~ | ~~0.1~~ |
| ~~B~~ | ~~4~~ | ~~3~~ | ~~1-POINT STAPLE~~ | ~~0.1~~ | ~~0.1~~ |
| C | 1 | 3 | STACK | 4 | 5=MAX(5,4) |
| C | 2 | 3 | STACK | 0.1 | 0.1 |
| C | 3 | 3 | STACK | 0.1 | 0.1 |

FIG. 7

| PRINT JOB | PAPER NO. | OUTPUT BIN | OUTPUT MODE | PREVIOUSLY DETERMINED OUTPUT PROCESS TIME (S) | STORED OUTPUT PROCESS TIME (S) |
|---|---|---|---|---|---|
| A | 1 | 3 | 2-POINT STAPLES | 0.1 | 0.1 |
| A | 2 | 3 | 2-POINT STAPLES | 0.1 | 0.1 |
| A | 3 | 3 | 2-POINT STAPLES | 0.1 | 0.1 |
| B | 1 | 3 | 1-POINT STAPLE | 5 | 5 |
| B | 2 | 3 | 1-POINT STAPLE | 0.1 | 0.1 |
| B | 3 | 3 | 1-POINT STAPLE | 0.1 | 0.1 |
| B | 4 | 3 | 1-POINT STAPLE | 0.1 | 0.1 |
| C | 1 | 3 | STACK | 4 | 4 |
| C | 2 | 3 | STACK | 0.1 | 0.1 |
| ~~C~~ | ~~3~~ | ~~3~~ | ~~STACK~~ | ~~0.1~~ | ~~0.1~~ |

FIG. 8

| PRINT JOB | PAPER NO. | OUTPUT BIN | OUTPUT MODE | PREVIOUSLY DETERMINED OUTPUT PROCESS TIME (S) | STORED OUTPUT PROCESS TIME (S) |
|---|---|---|---|---|---|
| A | 1 | 3 | 2-POINT STAPLES | 0.1 | 0.1 |
| A | 2 | 3 | 2-POINT STAPLES | 0.1 | 0.1 |
| A | 3 | 3 | 2-POINT STAPLES | 0.1 | 0.1 |
| ~~B~~ | ~~1~~ | ~~3~~ | ~~1-POINT STAPLE~~ | ~~5~~ | ~~5~~ |
| ~~B~~ | ~~2~~ | ~~3~~ | ~~1-POINT STAPLE~~ | ~~0.1~~ | ~~0.1~~ |
| ~~B~~ | ~~3~~ | ~~3~~ | ~~1-POINT STAPLE~~ | ~~0.1~~ | ~~0.1~~ |
| ~~B~~ | ~~4~~ | ~~3~~ | ~~1-POINT STAPLE~~ | ~~0.1~~ | ~~0.1~~ |
| ~~C~~ | ~~1~~ | ~~3~~ | ~~STACK~~ | ~~4~~ | ~~4~~ |
| ~~C~~ | ~~2~~ | ~~3~~ | ~~STACK~~ | ~~0.1~~ | ~~0.1~~ |
| ~~C~~ | ~~3~~ | ~~3~~ | ~~STACK~~ | ~~0.1~~ | ~~0.1~~ |

FIG. 9

| PRINT JOB | PAPER NO. | OUTPUT BIN | OUTPUT MODE | PREVIOUSLY DETERMINED OUTPUT PROCESS TIME (S) | STORED OUTPUT PROCESS TIME (S) |
|---|---|---|---|---|---|
| A | 1 | 3 | 2-POINT STAPLES | 0.1 | 0.1 |
| A | 2 | 3 | 2-POINT STAPLES | 0.1 | 0.1 |
| A | 3 | 3 | 2-POINT STAPLES | 0.1 | 0.1 |
| C | 1 | 3 | STACK | 5 | 5 |
| C | 2 | 3 | STACK | 0.1 | 0.1 |
| C | 3 | 3 | STACK | 0.1 | 0.1 |

FIG. 10A

| PRINT JOB | PAPER NO. | OUTPUT BIN | OUTPUT MODE | DETERMINED OUTPUT PROCESS TIME (S) |
|---|---|---|---|---|
| A | 1 | 3 | 2-POINT STAPLES | 0.1 |
| A | 2 | 3 | 2-POINT STAPLES | 0.1 |
| A | 3 | 3 | 2-POINT STAPLES | 0.1 |
| B | 1 | 3 | 1-POINT STAPLE | 5 |
| B | 2 | 3 | 1-POINT STAPLE | 0.1 |
| B | 3 | 3 | 1-POINT STAPLE | 0.1 |
| B | 4 | 3 | 1-POINT STAPLE | 0.1 |
| C | 1 | 3 | STACK | 4 |
| C | 2 | 3 | STACK | 0.1 |
| C | 3 | 3 | STACK | 0.1 |

FIG. 10B

| LIST OF NECESSARY TIME (S) | |
|---|---|
| TIME FOR 1-POINT STAPLE | 4 |
| TIME FOR 2-POINT STAPLES | 5 |
| TIME FOR RECEIVING STACK | 0.1 |
| MAX. NECESSARY TIME OF SYSTEM | 5 |

FIG. 11

| PRINT JOB | PAPER NO. | OUTPUT BIN | OUTPUT MODE | PREVIOUSLY DETERMINED OUTPUT PROCESS TIME (S) | STORED OUTPUT PROCESS TIME (S) |
|---|---|---|---|---|---|
| A | 1 | 3 | 2-POINT STAPLES | 0.1 | 0.1 |
| A | 2 | 3 | 2-POINT STAPLES | 0.1 | 0.1 |
| A | 3 | 3 | 2-POINT STAPLES | 0.1 | 0.1 |
| B | 1 | 3 | 1-POINT STAPLE | 5 | 5 |
| B | 2 | 3 | 1-POINT STAPLE | 0.1 | 0.1 |
| B | 3 | 3 | 1-POINT STAPLE | 0.1 | 0.1 |
| ~~B~~ | ~~4~~ | ~~3~~ | ~~1-POINT STAPLE~~ | ~~0.1~~ | ~~0.1~~ |
| C | 1 | 3 | STACK | 4 | 5 |
| C | 2 | 3 | STACK | 0.1 | 0.1 |
| C | 3 | 3 | STACK | 0.1 | 0.1 |

FIG. 12

| PRINT JOB | PAPER NO. | OUTPUT BIN | OUTPUT MODE | PREVIOUSLY DETERMINED OUTPUT PROCESS TIME (S) | STORED OUTPUT PROCESS TIME (S) |
|---|---|---|---|---|---|
| A | 1 | 3 | 2-POINT STAPLES | 0.1 | 0.1 |
| A | 2 | 3 | 2-POINT STAPLES | 0.1 | 0.1 |
| A | 3 | 3 | 2-POINT STAPLES | 0.1 | 0.1 |
| ~~B~~ | ~~1~~ | ~~3~~ | ~~1-POINT STAPLE~~ | ~~5~~ | ~~5~~ |
| ~~B~~ | ~~2~~ | ~~3~~ | ~~1-POINT STAPLE~~ | ~~0.1~~ | ~~0.1~~ |
| ~~B~~ | ~~3~~ | ~~3~~ | ~~1-POINT STAPLE~~ | ~~0.1~~ | ~~0.1~~ |
| ~~B~~ | ~~4~~ | ~~3~~ | ~~1-POINT STAPLE~~ | ~~0.1~~ | ~~0.1~~ |
| C | 1 | 3 | STACK | 4 | 5 |
| C | 2 | 3 | STACK | 0.1 | 0.1 |
| C | 3 | 3 | STACK | 0.1 | 0.1 |

IMAGE FORMING APPARATUS AND OUTPUT CONTROL METHOD OF THE SAME

BACKGROUND OF THE INVENTION

1. Field of the Invention

The present invention relates to an image forming apparatus and an output control method of the same, and more particularly, it relates to an image forming apparatus having an output processing device connected thereto and an output control method of the same for optimizing productivity of the overall apparatus.

2. Description of the Related Art

A known image forming apparatus having an output processing device detachably fixed thereto has a structure in which a paper-transport controller including a paper-transport controlling CPU is provided so as to supervise movements of both sheets of paper in the image forming apparatus and the output processing device in a centralized manner. The paper-transport controller employs a method for achieving the maximum throughput by determining a paper process time of the output processing device, paper transport speeds in the image forming apparatus and the output processing device, the lengths of a paper transport route and the sheet of paper, and an optimal print timing in accordance with the corresponding print mode (e.g., see Japanese Patent Laid-Open No. 9-39341, corresponding to U.S. Pat. No. 6,373,581).

That is, the known image forming apparatus disclosed in the above patent document includes timing-determining means for determining a timing of the following print command on the basis of a job schedule transmitted from an image-information controller, and the paper-transport controller unit includes timing-measuring means for measuring a timing for starting a print job thereat. With this arrangement, a CPU of the paper-transport controller shares a load to be processed by a CPU of the image-information controller. As a result, the process load is dispersed, thereby achieving improved speed of a print operation as a primary function of the image forming apparatus.

Also, an image forming apparatus proposed, e.g., in Japanese Patent Laid-Open No. 2004-271627 (corresponding to U.S. Application No. 2004-247336) has a structure in which a print operation thereof is controlled by transmitting an output-reservation command (reservation information) to the output processing device connected to the image forming apparatus and receiving a paper output interval from the output processing device, ranging from acceptance of the reserved sheet of paper to a possible acceptance of the following sheet of paper, both of the output processing device.

Unfortunately, with the above-described known structures, when a part of reserved information is canceled, the following problems may occur. That is, in the above-described known examples, information about print jobs serving as reservation information about a plurality of print jobs is transmitted to the output processing device. In other words, a plurality of pieces of print job information including a print job in process and another print job to be subsequently processed is transmitted to the output processing device.

For example, the output processing device recognizes an output process time on the basis of the transmitted print job information and, taking into account the output process time, controls the transport interval of a sheet of paper for the following print job. Thus, when print job information of a plurality of pieces of print jobs is canceled (deleted) midway through its execution, the output process times thereof are also canceled. Hence, the transport interval between the sheets of paper for the present and the following print jobs must be adjusted. Accordingly, after confirming that the print job in process is completely processed, the following print job must be processed, thereby causing a longer interval between the print jobs and resulting in decreased productivity.

When print job information is cancelled, continuing the process of the print job causes a paper jam between the sheet of paper in process and the following sheet of paper.

SUMMARY OF THE INVENTION

The present invention is directed to an image-forming method and an image forming apparatus for forming an image while achieving an optimal paper transport interval free from problems such as paper clogging and reduction in productivity even when a print job is canceled.

In one aspect of the present invention, an image forming apparatus includes an output processing device configured to determine an output process time in accordance with reservation information of a paper to be outputted; and a controller adjusting a paper transport interval in accordance with the output process time determined by the output processing device. Upon canceling the reservation information, the controller adjusts the paper transport interval of reservation information to be processed after the canceled reservation information on the basis of an output process time of reservation information to be processed before the canceled reservation information.

In another aspect of the present invention, an image forming apparatus includes an output processing device configured to determine an output process time in accordance with reservation information of a paper to be outputted; and a controller adjusting a paper transport interval in accordance with the output process time determined by the output processing device. Upon canceling the reservation information, the controller cancels all reservation information to be processed subsequently after the canceled reservation information, then obtains again the output process time by transmitting reservation information to be processed after the canceled reservation information to the output processing device, and adjusts the paper transport interval on the basis of the obtained output process time.

In another aspect of the present invention, an image forming apparatus includes an output processing device configured to determine an output process time in accordance with reservation information of a paper to be outputted; and a controller adjusting a paper transport interval in accordance with the output process time determined by the output processing device. Upon canceling the reservation information, the controller sets an output process time of reservation information to be processed after the canceled reservation information, as a maximum time of an outputting process of the output processing device and adjusts the paper output interval on the basis of the set output process time.

In another aspect of the present invention, an output control method of an image forming apparatus having a main body and an output processing device detachably attached to the main body thereof includes the steps of communicating with the output processing device so as to transmit reservation information about a paper outputting process to the output processing device and to obtain an output process time of the reservation information from the output processing device; and, upon canceling a part of the reservation information, adjusting a paper output interval of reservation information to be processed immediately after the canceled reservation information on the basis of reservation information to be processed right before the canceled reservation information.

In another aspect of the present invention, an output control method of an image forming apparatus having a main body and an output processing device detachably attached to the main body thereof includes the steps of: communicating with the output processing device so as to transmit reservation information about a paper outputting process to the output processing device and to obtain an output process time of the reservation information from the output processing device; re-communicating with the output processing device so as to cancel all reservation information to be processed subsequently after the canceled reservation information, then transmit reservation information to be processed immediately after the canceled reservation information, to the output processing device, and to obtain again the output process time; and adjusting a paper output interval on the basis of the output process time obtained in the re-communication step.

In another aspect of the present invention, an output control method of an image forming apparatus having a main body and an output processing device detachably attached to the main body thereof includes the steps of communicating with the output processing device so as to transmit reservation information about a paper outputting process to the output processing device and obtain an output process time of the reservation information from the output processing device; upon canceling a part of the reservation information, setting an output process time of reservation information to be processed immediately after the canceled reservation information, as a maximum time of a paper outputting process of the output processing device; and adjusting a paper output interval on the basis of the output process time set in the setting step.

Further features of the present invention will become apparent from the following description of exemplary embodiments with reference to the attached drawings.

BRIEF DESCRIPTION OF THE DRAWINGS

FIGS. 3A and B illustrate that a CPU in an output device determines what output process time in accordance with reservation information according to the first and a second embodiments.

FIG. 4 illustrates a method for canceling reservation information according to the first embodiment.

FIG. 5 illustrates the method for canceling reservation information according to the first embodiment.

FIG. 6 illustrates the method for canceling reservation information according to the first embodiment.

FIG. 7 illustrates a method for canceling reservation information according to the second embodiment.

FIG. 8 illustrates the method for canceling reservation information according to the second embodiment.

FIG. 9 illustrates the method for canceling reservation information according to the second embodiment.

FIGS. 10A and B illustrate that the CPU in the output device determines the output process time in accordance with reservation information according to a third embodiment.

FIG. 11 illustrates a method for canceling reservation information according to the third embodiment.

FIG. 12 illustrates the method for canceling reservation information according to the third embodiment.

DESCRIPTION OF THE EMBODIMENTS

Embodiments of the present invention will be described with reference to the accompanying drawings.

First Embodiment

Figure 1:
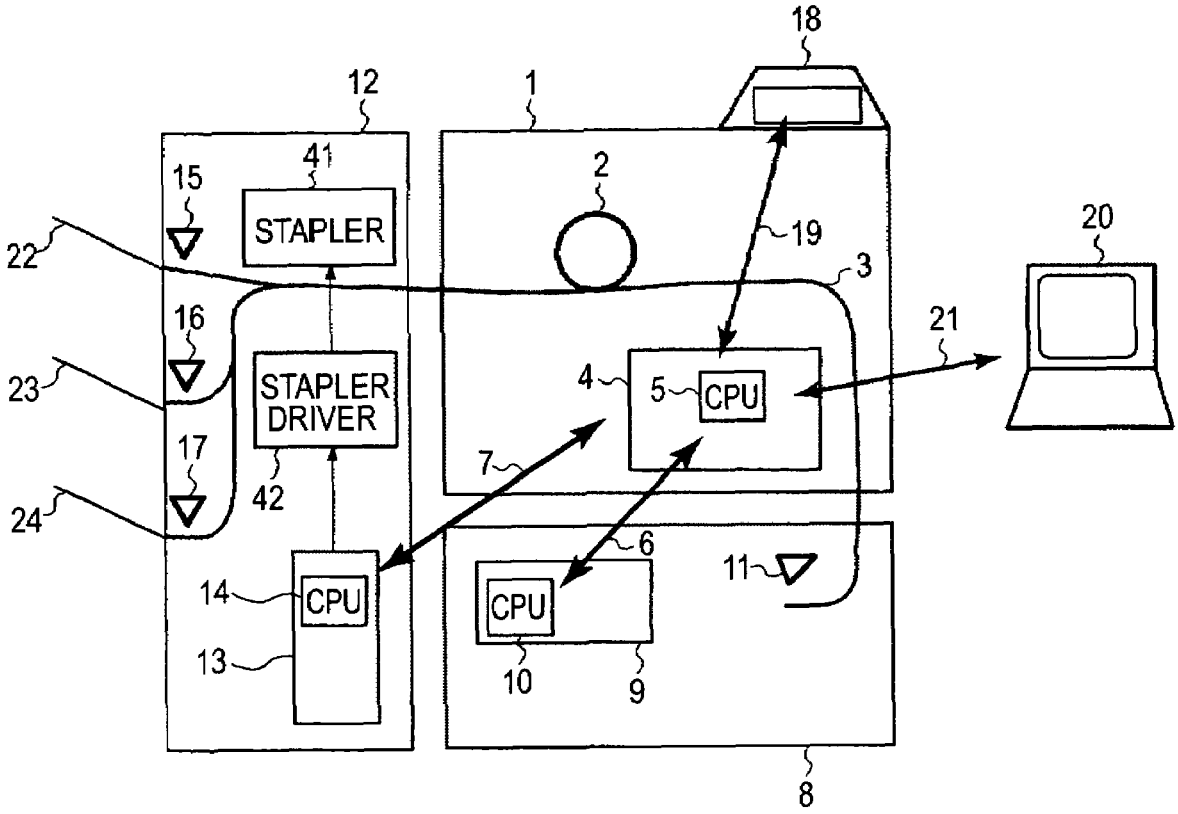
FIG. 1 is a schematic diagram of an image forming apparatus according to a first embodiment of the present invention.

FIG. 1 is a schematic sectional view of the main body and option devices of an image forming apparatus according to a first embodiment of the present invention. The image forming apparatus includes its main body 1, an image-forming processing section 2, an image-forming control board 4, a CPU 5 of an image-forming section thereof, a feed device 8, an output device 12, communication lines 6 and 7 respectively with the feed device 8 and the output device 12, a control board 9 of the feed device 8, a CPU 10 of the feed device 8, and a paper-detecting sensor 11. The feed device 8 and the output device 12 are option devices.

The output device 12 includes a control board 13, a CPU 14, paper output sensors 15, 16, and 17, paper output trays 22, 23, and 24, an operation panel 18, a stapler 41 (a device stapling sheets of paper), and a stapler driver 42 of the stapler 41. Reference numbers 3, 19, 20, and 21 in the figure respectively denote a paper transport route, an operation-panel control signal, an external computer 20, and a communication line with the external computer 20.

With the configuration of the image forming apparatus shown in FIG. 1, the main body 1 according to the present embodiment performs an image-forming operation in accordance with an instruction of the external computer 20. In order to allow the feed device 8 to operate normally, the main body 1 computes the number of sheets of paper necessary for forming an image and executes reservation information about paper transport and an output process via the communication line 6 with the feed device 8. Also, in order to set an output state of the output device 12, the main body 1 executes reservation information about paper transport and an output process in response to a designation of the external computer 20 via the communication line 7 with the output device 12.

Reservation is executed by transmitting reservation information to the CPU 14 of the output device 12. The transmitted reservation information is stored in a memory (not shown) in the CPU 14 together with an output process time needed for a paper outputting process.

The output device 12 determines an output process time needed for the outputting process corresponding to the transmitted reservation information, and informs the main body 1 of the output process time. As an output-processing method, either 1-point staple or 2-point staple can be chosen by a printer driver of the external computer 20, and the choice can be reserved in the output device 12.

While times needed for processing 1-point staple and 2-point staple are different from each other, on the basis of reservation information transmitted to and stored in the CPU 14 of the output device 12, the output device 12 determines an optimal output process time in accordance with the corresponding reservation information and informs the main body 1 of the optimal output process time. The main body 1 stores the determined output process time in a memory (not shown) in the CPU 5.

The main body 1 adjusts a paper transport interval in response to the determined output process time. In accordance with the reservation information about paper transport transmitted from the CPU 5, the feed device 8 starts feeding a sheet of paper in the same fashion as the output device 12. The fed sheet of paper is sent into the main body 1 along the paper transport route 3. The feed device 8 determines whether, upon passing of the fed sheet of paper through the paper-detecting sensor 11, the following sheet of paper is present.

An image is formed on the sheet of paper sent into the main body, and the sheet of paper is outputted to the output device 12. The sheet of paper transported in the output device 12 is outputted to the corresponding tray in accordance with the reservation information.

The output device 12 checks normal operations of the respective paper output sensors 15, 16, and 17 and determines whether the sheet of paper is completely outputted to the corresponding one of the paper output trays 22, 23, and 24. Also, the output device 12 staples the sheets of paper outputted by the stapler 41 in accordance with the reservation information stored in the CPU 14 of the output device 12. On this occasion, the reservation information includes the choice regarding the number of stapling points, i.e., a 1-point staple or 2-point staple, thereby having the stapler 41 operate in accordance with the choice information.

When the reservation information includes a staple instruction in the present embodiment, the image forming apparatus is set such that a plurality of stapling sheets of paper is temporarily stacked in the output device 12, stapled by the stapler 41, and outputted to the paper output tray 22.

In other words, the image forming apparatus according to the present embodiment includes a storage section in the CPU 5 for storing reservation information and an output process time so as to output a sheet of paper to the output device 12 connected thereto, and the reservation information stored in the storage section is transmitted to the output device 12. The output device 12 transmits the output process time to the image forming apparatus in accordance with the reservation information. The image forming apparatus includes the control section 5 (i.e., the CPU 5) adjusting a paper transport interval in accordance with the output process time determined by the output device 12.

The control section 5 of the main body 1 is configured, upon canceling reservation information, so as to determine a new output process time by comparing an output process time previously determined to the canceling sheet of paper with those previously determined to the other sheets of paper.

Figure 2:
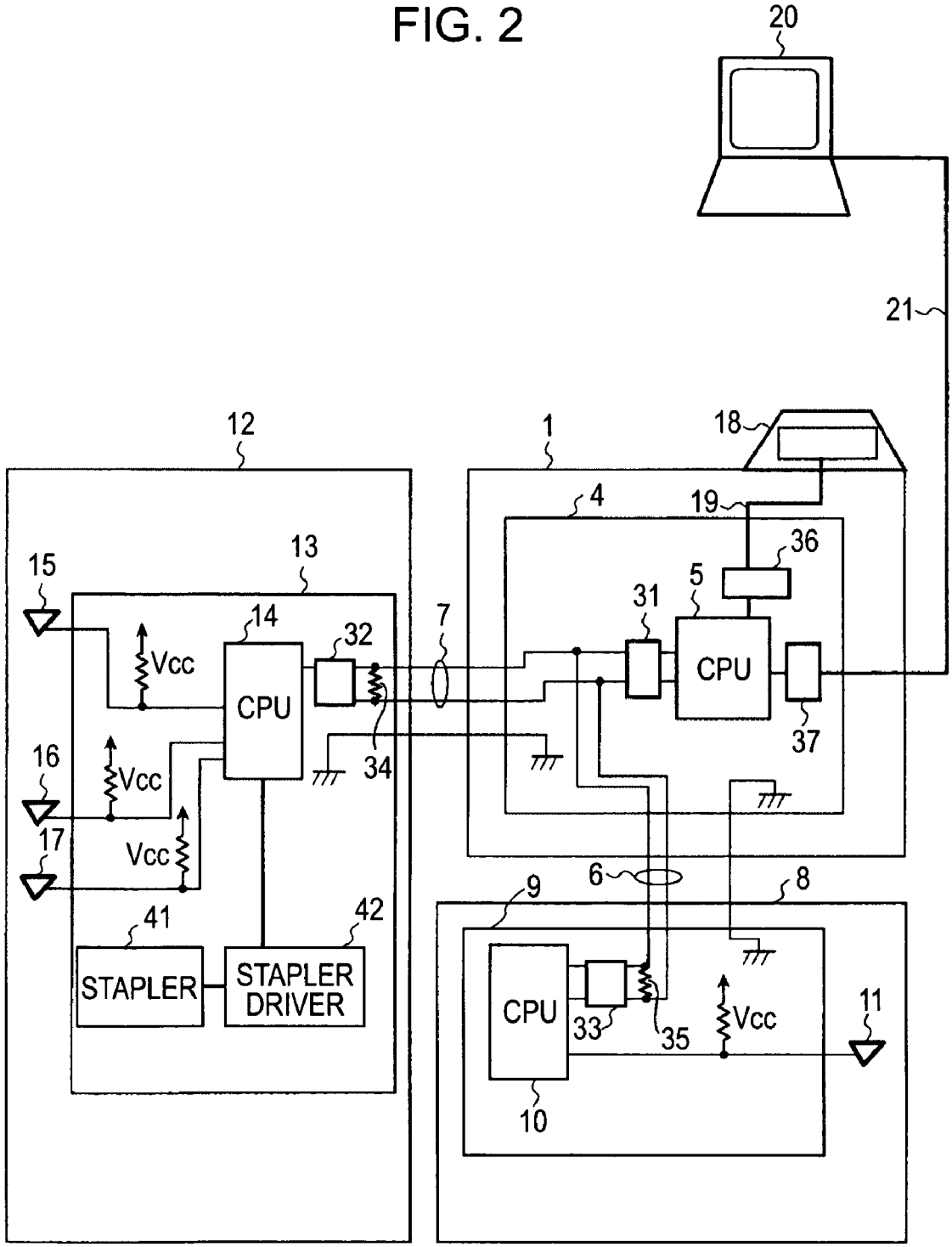
FIG. 2 is a diagram illustrating the relationship between each of CPUs and input/output elements of the image forming apparatus shown in FIG. 1, according to the first embodiment.

FIG. 2 is a structural diagram illustrating the relationship between each of the CPUs and input/output elements of the image forming apparatus shown in FIG. 1, according to the first embodiment. As shown in the figure, the image forming apparatus includes I/F-ICs 31, 32, and 33, terminal resistors 34 and 35 for communication, a buffer 36 for the operation panel 18, and an I/F-IC 37 of the communication line 21.

A print command is transferred to the CPU 5 via the communication line 21 with the external computer 20. The CPU 5 performs a printing process by controlling the image-forming processing section 2. Also, the CPU 5 transmits reservation information regarding paper transport to the feed device 8 via the communication line 6 with the feed device 8 and regarding paper transport and a paper outputting process to the output device 12 via the communication line 7 with the output device 12. The I/F-ICs 31, 32, and 33 serve as communication buffers so that a plurality of the CPUs can be connected to a common communication line.

Each of the CPUs 5, 10, and 14 has a ROM storing a program, a RAM executing the program, and a communication interface (I/F) controlling communication built therein. The CPU 10 obtains reservation information via the communication line 6 with the feed device 8. The reservation information includes, for example, data about the number of sheets of paper to be fed from the feed device 8 and about a feeding process.

The CPU 10 controls a feeding operation of the feed device 8 and, in addition, determines whether a sheet of paper exists in the feed device 8 by capturing a detected value of the paper-detecting sensor 11 through an input port.

The CPU 14 obtains reservation information (i.e., paper transport information) via the communication line 7 with the output device 12. The reservation information includes data regarding the number of sheets of paper to be outputted to each of the trays of the output device 12 and regarding choice of the number of staples, e.g., either a 1-staple or 2-staple.

Also, the CPU 14 controls an outputting operation of the output device and determines whether the sheet of paper in process is outputted completely by capturing detected values of the paper output sensors 15, 16, and 17 through respective ports. Also, the CPU 14 activates the stapler 41 through the stapler driver 42 so as to perform a stapling operation: a 1-point staple or 2-point staple, in accordance with the reservation information.

FIGS. 3A and 3B illustrate that the CPU 14 in the output device 12 determines the output process time in accordance with reservation information, wherein FIG. 3A illustrates determined output process times (seconds) for respective print JOBs, serving as the reservation information, and FIG. 3B is a table showing necessary output process times (seconds). In other words, FIGS. 3A and B illustrate that the CPU 14 in the output device 12 determines the output process time in accordance with reservation information.

It is presumed that three print JOBs are generated on the external computer 20 as illustrated in FIG. 3A. These print JOBs, called JOB-A, JOB-B, and JOB-C, are determined to the output device 12 as reservation information. With respect to JOB-A, three sheets of paper are stapled at two points. With respect to JOB-B, four sheets of paper are stapled at a single point, and with respect to JOB-C, three sheets of paper are stacked and outputted without stapling. In the meantime, reservation information is set for each sheet of paper and transmitted as illustrated in FIG. 3A.

As illustrated in FIG. 3B, the output device 12 requires four (4) seconds for carrying out a 1-point staple, five (5) seconds for carrying out a 2-point staple, and 0.1 seconds for normally receiving a sheet of paper (i.e., a stack-receipt time).

An output process time to be determined from the output device 12 is returned to the same as a waiting time period for a designated sheet of paper to be printed. Accordingly, a time needed for stapling of JOB-A is maintained by keeping the first sheet of paper of JOB-B waiting. That is, a time needed for 2-point staple of JOB-A is determined while being reflected on the first sheet of paper of the following JOB.

When paper transport information (reservation information) is previously determined to the output device 12 as described above, the output device 12 returns a time needed for a paper outputting process on the basis of the reservation information to the image forming apparatus.

FIGS. 4 to 6 illustrate a method for canceling reservation information, of the image forming apparatus according to the first embodiment, wherein two kinds of output process times (seconds) previously determined to the image forming apparatus and stored in the image forming apparatus are shown for each print JOB.

As illustrated in FIG. 4, respective pieces of paper transport information (reservation information) of JOB-A, JOB-B, and JOB-C are previously determined to the output device 12 upon start of JOB-A. With this, it is presumed that, after start of printing JOB-A and midway through printing of the second sheet of paper of JOB-A, cancellation of JOB-B is instructed from the operation panel 18.

A canceling operation of JOB-B starts from the fourth page, i.e., the final page of JOB-B. First, paper transport information (reservation information) in the fourth page of JOB-B is canceled. On this occasion, with respect to a sheet of paper including information to be canceled, the previously determined output process time and the output process time of the page following the canceled page are compared to each other, and the greater one is written as a new output process time over that stored at a position corresponding to the page following the canceled page. In the figure, MAX (A, B) indicates a function providing the greater one between A and B. In the fourth page of JOB-B, A=0.1 and B=4, resulting in a computation: MAX (0.1, 4)=4.

Subsequently, as illustrated in FIG. 5, the paper transport information (reservation information) in the third and then second pages of JOB-B is canceled in the same fashion as with the above-described method.

Referring now to FIG. 6, a canceling process of the reservation information in the first page of JOB-B will be described. The output process time stored in the page following the canceled page is four (4) seconds and the previously determined output process time of the canceled page is five (5) seconds. The greater one of these two times is written as a new output process time over that stored at a position corresponding to the page following the canceled page. In other words, a computation: MAX (5, 4)=5, is obtained, and a value of five (5) seconds is overwritten as a new output process time.

With this operation, upon completing cancellation of JOB-B, the output process time needed for performing a paper outputting process (2-point stable) of JOB-A is reflected on the stored output process time of the first sheet of paper of JOB-C.

According to the first embodiment, as described above, when JOB-A is carried out and JOB-C is then carried out, a printing operation of the image forming apparatus can be continued free from a jam problem and a decrease in throughput. That is, even when a JOB is canceled midway through its execution, a printing operation free from a jam problem and a reduction in productivity can be achieved.

Second Embodiment

FIGS. 7 to 9 illustrate a method for canceling reservation information, of an image forming apparatus according to a second embodiment of the present invention, wherein a previously determined output process time (seconds) and a stored output process time (seconds) are shown for each print JOB.

As illustrated in FIG. 7, respective pieces of paper transport information (reservation information) of JOB-A, JOB-B, and JOB-C are previously determined to the output device 12 upon start of JOB-A. With this, it is presumed that, after start of printing JOB-A and midway through printing of the second sheet of paper of JOB-A, cancellation of JOB-B is instructed from the operation panel 18.

According to the second embodiment, the canceling operation of JOB-C starts from the third page as the final page of JOB-C. On this occasion, the previously determined output process times (stored in the CPU 14 of the output device) and those stored in the CPU 5 of the image forming apparatus are deleted at the same time.

Next, as illustrated in FIG. 8, the above-described process is likewise applied to the first page of JOB-B. Subsequently, as illustrated in FIG. 9, the necessary paper transport information (reservation information) of JOB-C is newly determined to the output device 12. While the output device 12 can recognize that JOB-C is to be carried out after JOB-A, it can return five (5) seconds as the output process time.

As described above, according to the second embodiment, when JOB-B is canceled, JOB-C following JOB-B is canceled at the same time, and after the cancellation, the reservation information of JOB-C is newly transmitted to the output device. With this, when JOB-A is carried out and JOB-C is then carried out, the printing operation of the image forming apparatus can be continued free from a jam problem and a decrease in throughput. That is, even when a JOB is canceled midway through its execution, the maximum throughput can be established, and a stable operation can be achieved without any sequence such as computation by using a function for calculating the maximum value.

Third Embodiment

FIGS. 10A and 10B illustrate that the CPU in the output device determines the output process time in accordance with reservation information, wherein FIG. 10A illustrates determined output process times (seconds) for respective print JOBs and FIG. 10B is a table showing necessary output process times (seconds).

FIGS. 11 and 12 illustrate a method for canceling reservation information, of an image forming apparatus according to a third embodiment of the present invention, wherein a previously determined output process time (seconds) and a stored output process time (seconds) are shown for each print JOB.

As illustrated in FIG. 10, the maximum necessary time of a system of the image forming apparatus is added to the case of the first embodiment. FIG. 10 in the third embodiment illustrates that the CPU 14 in the output device 12 determines the output process time in accordance with reservation information.

On this occasion, the previously determined output process times (stored in the CPU 14 of the output device 12) are written at the same time in a storage area for storing the output process times, of a memory (not shown) of the CPU 5 of the image forming apparatus. Accordingly, the previously determined output process times have the same values as the stored output process times.

Respective pieces of paper transport information (reservation information) of JOB-A, JOB-B, and JOB-C are previously determined to the output device 12 upon start of JOB-A. With this, it is presumed that, after start of printing JOB-A and midway through printing of the second sheet o paper of JOB-A, cancellation of JOB-B is instructed from the operation panel 18.

As illustrated in FIG. 11, according to the third embodiment, upon canceling the fourth page serving as the final page of JOB-B, both the previously determined output process time and the stored output process time are deleted at the same time.

More particularly, a value zero "0" is written in each of the previously determined output process time and the stored output process time. Then, the maximum output process time needed for the system, i.e., the maximum process time (5 seconds in the present embodiment) needed for the system is overwritten as a stored output process time at a position corresponding to the page following the canceled page. As a result, the maximum process time (5 seconds) needed for the system is written as the stored output process time of the paper No. 1 of JOB-C.

In this case, in order to carry out the above-described work, the previously determined output process time and the stored output process time for each sheet of paper must be administrated. Subsequently, as illustrated in FIG. 12, the above-described process is likewise applied to the third, second, and first pages of JOB-B.

As described above, according to the third embodiment, even when the canceling operation of reservation information causes the output device 12 to change, the paper transport interval can be kept in a form of the maximum output process time needed for the system, thereby reliably preventing a jam problem.

According to the present embodiment, even when the reserved print job is canceled, a jamming does not take place, and a print operation can be achieved without a decrease in throughput, thereby offering a comfortable printing environment to an operator.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-317064 filed Oct. 29, 2004, and No. 2005-281954 filed Sep. 28, 2005, which are hereby incorporated by reference herein in their entirety.

What is claimed is:

1. An image forming apparatus, comprising:

an output processing device configured to determine an output process time in accordance with reservation information of a paper to be outputted; and a controller adjusting a paper transport interval in accordance with the output process time determined by the output processing device, wherein, upon canceling the reservation information, the controller adjusts the paper transport interval of reservation information to be processed after the canceled reservation information on the basis of an output process time of reservation information to be processed before the canceled reservation information.

2. The image forming apparatus according to claim 1, wherein the controller determines an output process time of reservation information to be processed after the canceled reservation information on the basis of output process times of reservation information to be processed before the canceled reservation information and the canceled reservation information.

3. The image forming apparatus according to claim 1, wherein the output processing device includes a stapler and the reservation information includes data regarding a stapling process of the paper.

4. An image forming apparatus, comprising:

an output processing device configured to determine an output process time in accordance with reservation information of a paper to be outputted; and a controller adjusting a paper transport interval in accordance with the output process time determined by the output processing device, wherein, upon canceling the reservation information, the controller cancels all reservation information to be processed subsequently after the canceled reservation information, then re-determines the output process time by transmitting reservation information to be processed after the canceled reservation information to the output processing device, and then adjusts the paper transport interval on the basis of the re-determined output process time.

5. The image forming apparatus according to claim 4, wherein the output processing device includes a stapler and the reservation information includes data regarding a stapling process of a sheet of paper.

6. An image forming apparatus, comprising:

an output processing device configured to determine an output process time in accordance with reservation information of a paper to be outputted; and a controller adjusting a paper transport interval in accordance with the output process time determined by the output processing device, wherein, upon canceling the reservation information, the controller sets an output process time of reservation information to be processed after the canceled reservation information, as a maximum time of a paper outputting process of the output processing device, and adjusts the paper output interval on the basis of the set output process time.

7. The image forming apparatus according to claim 6, wherein the output processing device includes a stapler and the reservation information includes data regarding a stapling process of a sheet of paper.

8. An output control method of an image forming apparatus having a main body and an output processing device detachably attached to the main body thereof, comprising the steps of:

communicating with the output processing device so as to transmit reservation information about a paper outputting process to the output processing device and to obtain an output process time of the reservation information from the output processing device; and adjusting, upon canceling a part of the reservation information, a paper output interval of reservation information to be processed after the canceled reservation information on the basis of reservation information to be processed immediately before the canceled reservation information.

9. The output control method according to claim 8, wherein the communication step includes the step of determining an output process time of reservation information to be processed immediately after the canceled reservation information on the basis of output process times of reservation information to be processed immediately before the canceled reservation information and the canceled reservation information.

10. The output control method according to claim 8, wherein the output processing device includes a stapler and the reservation information includes data regarding a stapling process of a sheet of paper.

11. An output control method of an image forming apparatus having a main body and an output processing device detachably attached to the main body thereof, comprising the steps of:

communicating with the output processing device so as to transmit reservation information about a paper outputting process to the output processing device and to obtain an output process time of the reservation information from the output processing device;

re-communicating with the output processing device so as to cancel all reservation information to be processed subsequently after the canceled reservation information, then transmit reservation information to be processed after the canceled reservation information, to the output processing device, and obtain again the output process time; and adjusting a paper output interval on the basis of the output process time obtained in the re-communication step.

12. The output control method according to claim 11, wherein the output processing device includes a stapler and the reservation information includes data regarding a stapling process of a sheet of paper.

13. An output control method of an image forming apparatus having a main body and an output processing device detachably attached to the main body thereof, comprising the steps of:

communicating with the output processing device so as to transmit reservation information about a paper outputting process to the output processing device and to obtain an output process time of the reservation information from the output processing device;

setting, upon canceling a part of the reservation information, an output process time of reservation information to be processed after the canceled reservation information, as a maximum time of a paper outputting process of the output processing device; and adjusting a paper output interval on the basis of the output process time set in the setting step.

14. The output control method according to claim 13, wherein the output processing device includes a stapler and the reservation information includes data regarding a stapling process of a sheet of paper.

* * * * *